US007975352B2

(12) United States Patent
Landin

(10) Patent No.: US 7,975,352 B2
(45) Date of Patent: Jul. 12, 2011

(54) ACCESS DOOR LEVER

(76) Inventor: Hope Landin, Livermore, CA (US)

( * ) Notice: Subject to any disclaimer, the term of this patent is extended or adjusted under 35 U.S.C. 154(b) by 0 days.

(21) Appl. No.: 12/319,385

(22) Filed: Jan. 7, 2009

(65) Prior Publication Data

US 2009/0172917 A1 Jul. 9, 2009

Related U.S. Application Data

(60) Provisional application No. 61/019,325, filed on Jan. 7, 2008.

(51) Int. Cl.
*E05B 1/00* (2006.01)

(52) U.S. Cl. ..... 16/413; 16/422

(58) Field of Classification Search ..... 16/413, 16/414, DIG. 30, 433, 441, 412, 422, 426; 292/347, 336.3, DIG. 2
See application file for complete search history.

(56) References Cited

U.S. PATENT DOCUMENTS

| | | | | | |
|---|---|---|---|---|---|
| 629,999 | A * | 8/1899 | Jacobs | 74/557 |
| 2,610,877 | A * | 9/1952 | Weaver | 292/1 |
| 2,808,282 | A * | 10/1957 | Peoples | 292/347 |
| 3,306,643 | A * | 2/1967 | Reed | 292/1 |
| 3,556,571 | A * | 1/1971 | Laub, Jr. | 292/1 |
| 3,575,453 | A | 4/1971 | Hohl | |
| 3,827,739 | A | 8/1974 | Overholser | |
| 4,018,465 | A | 4/1977 | Ramler | |
| 4,223,931 | A | 9/1980 | Neary | |
| 4,285,536 | A * | 8/1981 | McCoy et al. | 292/336.3 |
| 4,397,489 | A * | 8/1983 | Lind | 292/347 |
| 4,504,087 | A * | 3/1985 | Pennington | 292/347 |
| 4,913,479 | A * | 4/1990 | Allison | 292/347 |
| 4,971,375 | A * | 11/1990 | Grecco | 292/347 |
| 5,231,731 | A * | 8/1993 | Jones, Jr. | 16/412 |
| 5,495,641 | A | 3/1996 | Going | |
| 6,122,945 | A * | 9/2000 | Grant | 70/426 |
| 2008/0086842 | A1 * | 4/2008 | Dayton et al. | 16/412 |

OTHER PUBLICATIONS

Patterson Medical Inc., Website Catalog from Sammons Preston, Door Knob Turner.

* cited by examiner

*Primary Examiner* — William L. Miller
(74) *Attorney, Agent, or Firm* — Metz Lewis Brodman Must O'Keefe LLC; Barry I. Friedman

(57) ABSTRACT

The Access Door Lever is a device which provides an easier way to open a door with a traditional doorknob. In one embodiment, the invention will fit over a traditional doorknob, snap in place with finger-like extensions, which will grip the doorknob. The extension is coated with a material which will provide a secure grip between the doorknob and extension. The design and location of the extension(s) allow for a snug fit with the doorknob. A handle which is connected to the extension(s) allow the invention to function as a lever on the doorknob.

10 Claims, 5 Drawing Sheets

ACCESS DOOR LEVER

RELATED APPLICATION

This application claims the benefit of U.S. Provisional Application No. 61/019,325.

STATEMENT RE: FEDERALLY SPONSORED RESEARCH OR DEVELOPMENT

The claimed invention was not sponsored by any federally sponsored research or development.

REFERENCE TO COMPACT DISCS

There were no compact disc(s) which were submitted with the application.

BACKGROUND OF THE INVENTION

Many individuals have difficulties wrapping their hands around and operating a traditional doorknob such as a cylindrical, round or spherical doorknob. For example, elderly users or those individuals with hand debilities such as arthritis or venal carpal syndrome lack the physical strength to turn doorknobs, resulting in these individuals leaving the door(s) open to maintain access through the door. This situation can result in lack of privacy, a dangerous or security concern, and may result in increased heating and cooling bills as well. Without an easier way to open a door with a traditional doorknob, some individuals may be unable to enter or move freely inside their home. A device is needed which will offer a more convenient method for opening a door, making any traditional doorknob, such as a cylindrical, round or spherical doorknob easier to turn. Ideally, such a device would be less expensive than retrofitting the existing door with new hardware, and would be easy to install on virtually any door equipped with a traditional doorknob, ensuring that youngsters, elderly, or other individuals with debilities in operating traditional doorknobs, may access any room in the home with a simple push of the lever.

BRIEF SUMMARY OF THE INVENTION

The object of the invention is to provide a lever to operate a traditional doorknob. The invention will fit over a traditional doorknob or standard doorknob, and snap in place with finger-like extension(s), which will grip the doorknob. The extension(s) with gripping material, perform the function of fingers in gripping and turning a doorknob. The invention snaps in place when the extension(s) slip over and grips the doorknob. The extension(s) are covered with a material which will provide a secure grip between the doorknob and finger-like extensions. A handle is attached to the base of the extension(s) by a collar which will allow the invention to function as a lever on the doorknob.

BRIEF DESCRIPTION OF THE DRAWINGS

FIGS. 4A, 4B, 4C and 4D are cross-sectional side views of one embodiment of the device of the invention which depict the placement of a material providing grip between the doorknob and extension(s);

DETAILED DESCRIPTION OF THE INVENTION

The invention involves a device which will slip over, grip and act as a lever on a traditional doorknob. Such an invention is particularly useful for individuals suffering from one of numerous hand debilities which renders it difficult or painful to grasp or twist a traditional doorknob.

In the following description, numerous specific details are set forth, in order to provide a thorough understanding of the invention. It will be obvious, however, to one skilled in the art that the invention may be practiced without these specific details or dimensions. Some well known methods and structures have not been set forth in order not to unnecessarily obscure the description of the invention.

Figure 1A:
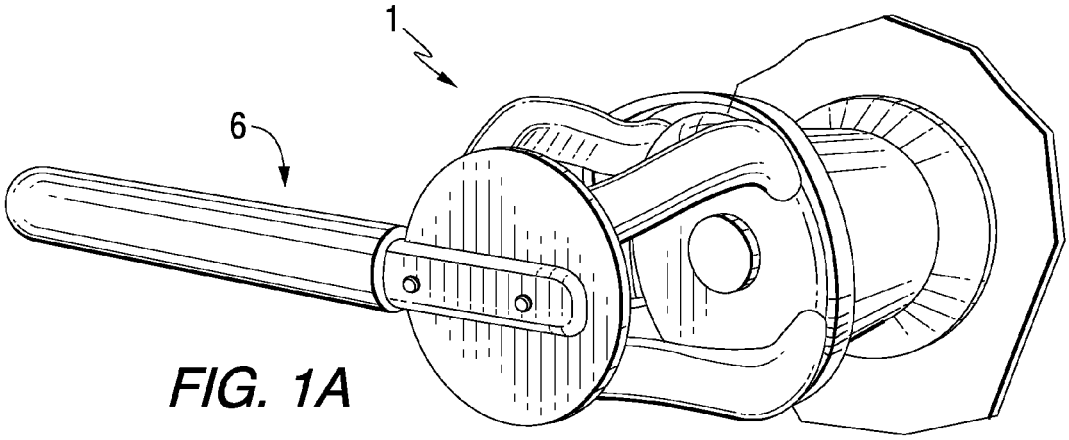
FIGS. 1A, 1B and 1C are perspective views of one embodiment of the device of the invention.
Figure 1B:
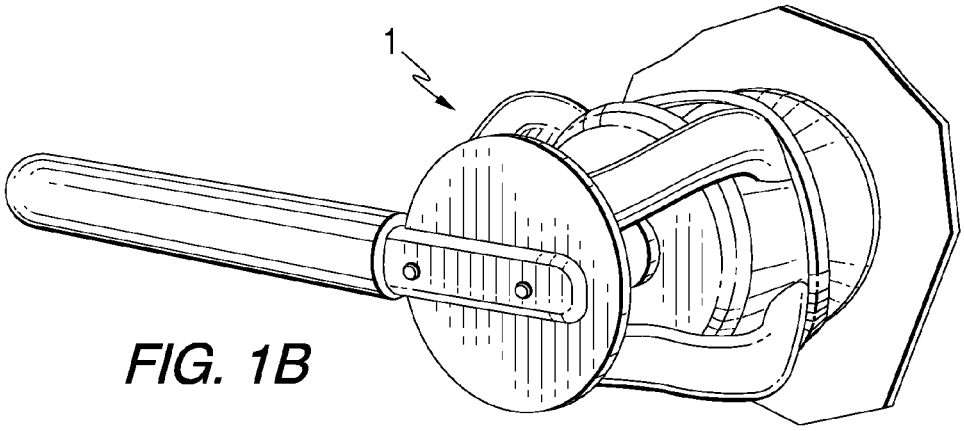
Figure 1C:
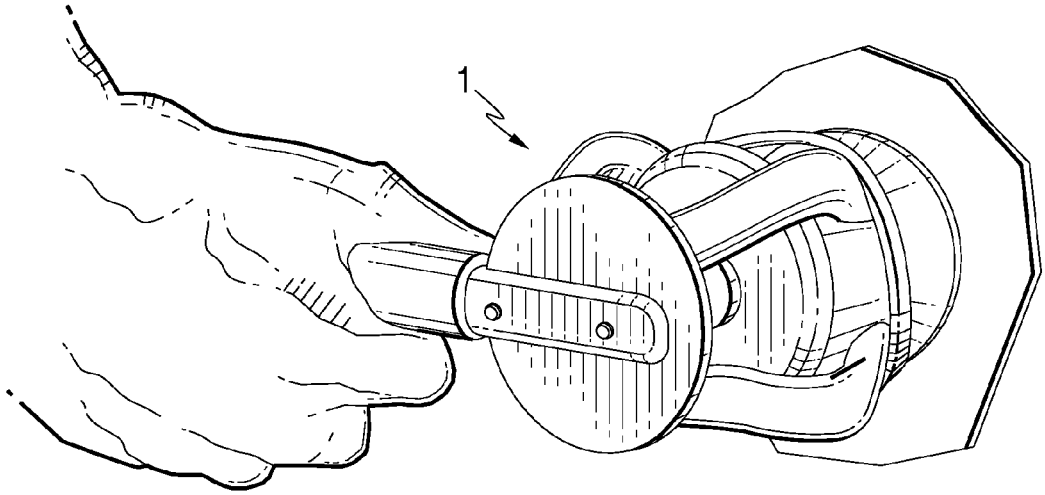

The invention can be better understood by reference to FIGS. 1A, 1B and 1C. A traditional doorknob can be turned or twisted to effectuate movement of the door's striker in order to open the door. The invention 1 slips over the doorknob.

Figure 2A:
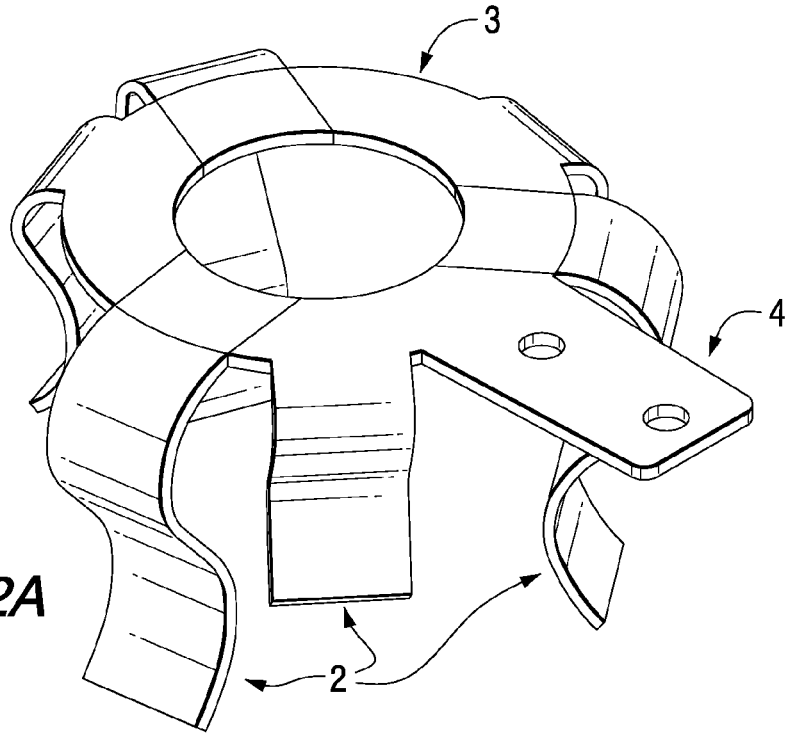
FIG. 2A is a perspective view from the top of one embodiment of the device of the invention without the lever attached.
Figure 2B:
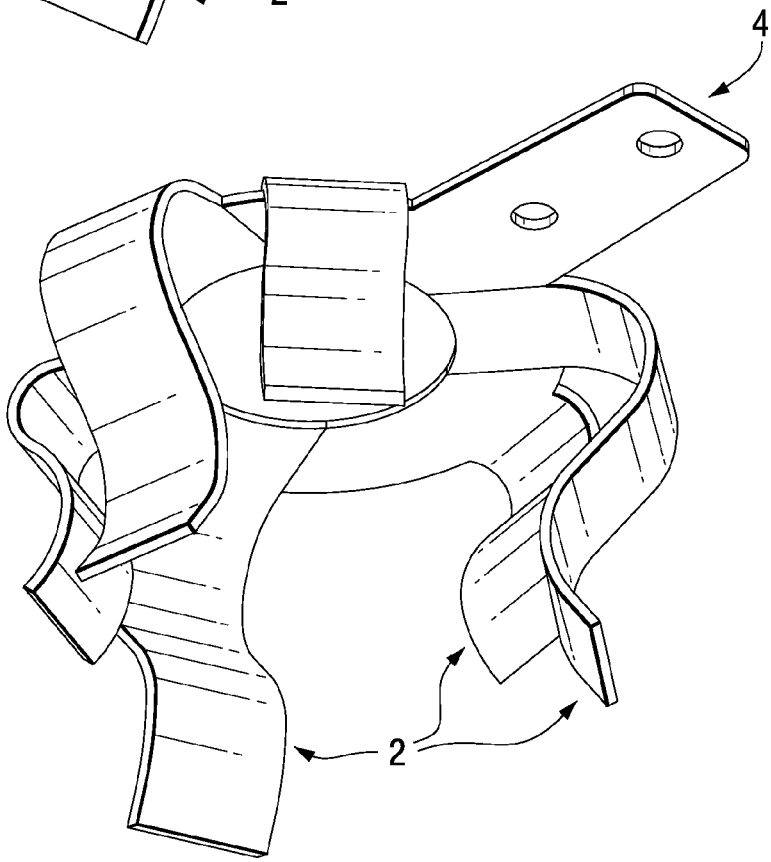
FIG. 2B is a perspective view from the bottom of one embodiment of the device of the invention without the lever attached.
Figure 3:
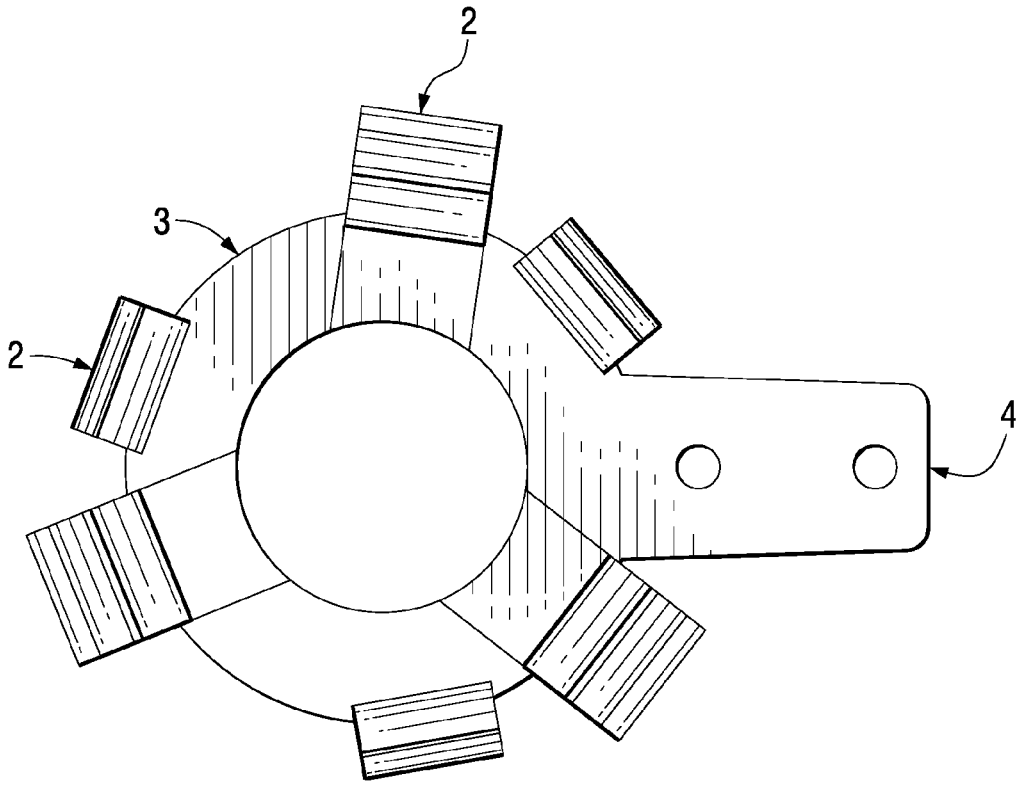
FIG. 3 is a perspective view from the top of one embodiment of the device of the invention.
Figure 4B:
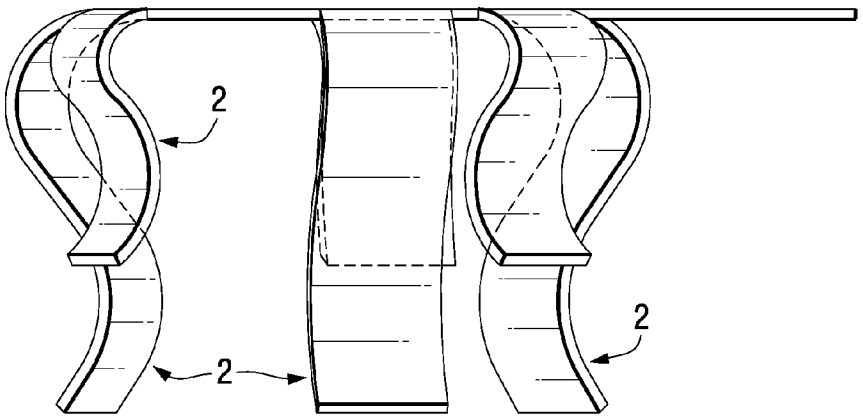
Figure 4A:
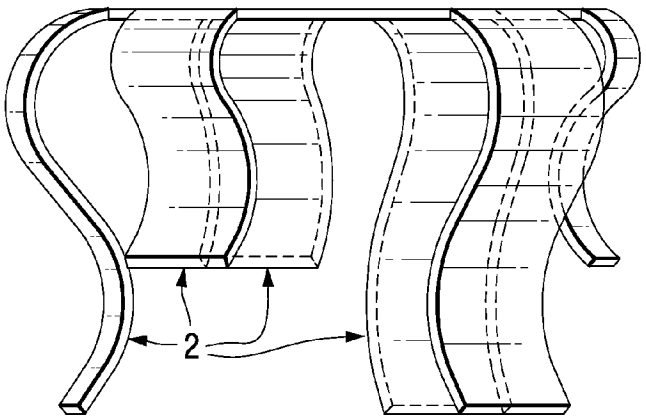
Figure 4C:
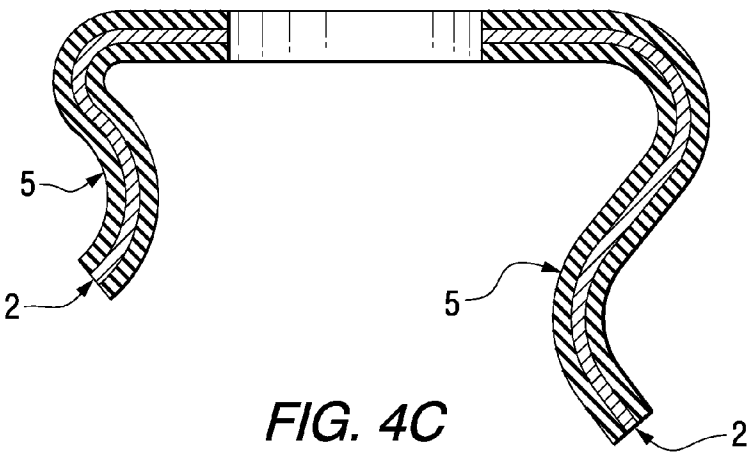

Referring to FIGS. 4A-4C, the extension(s) 2 are coated with a material 5 which will provide a grip between the extension and the doorknob. This material 5 may comprise of rubber, elastomeric material, neoprene, polymer or some other material which can be applied on the extension 2 to provide a gripping force, but will allow the extension 2 to slip over the doorknob. The design and placement of the extension (s) 2 allow the extension(s) to snugly grip the doorknob through the gripping material 5. Referring to FIGS. 2A, 2B and 3, a collar 3 connects the extension(s) 2 to a lever connection 4. A lever 6 (as illustrated in FIG. 1A) is connected to the lever connection 4.

Figure 5A:
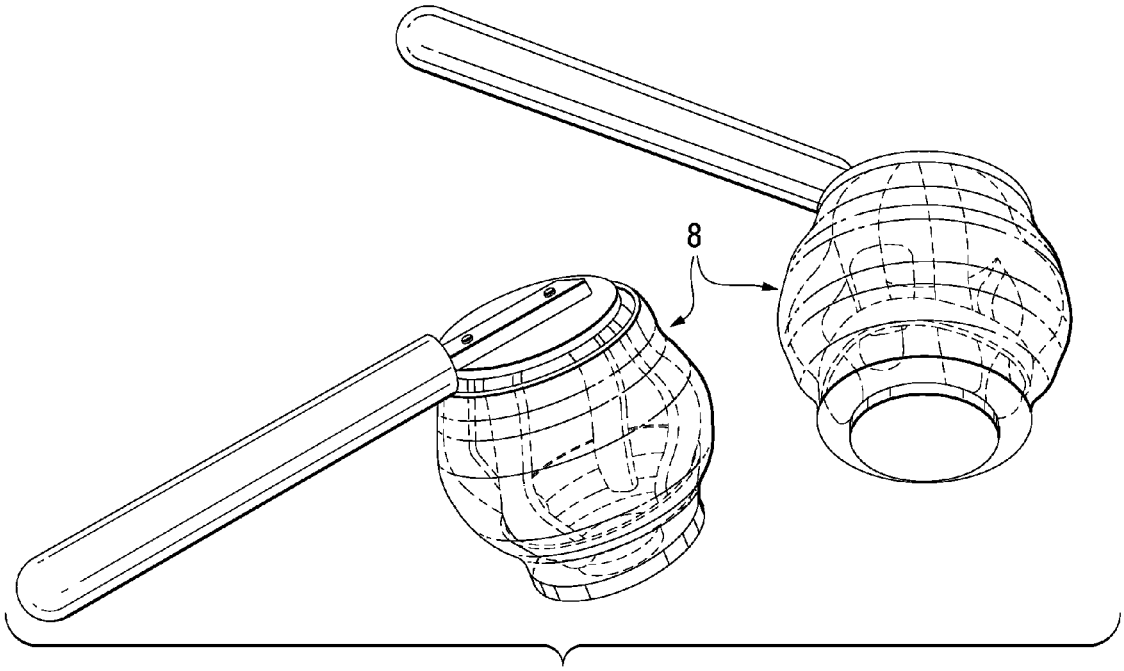
FIGS. 5A and 5B are perspective views of one embodiment of the device of the invention illustrating a cover.
Figure 5B:
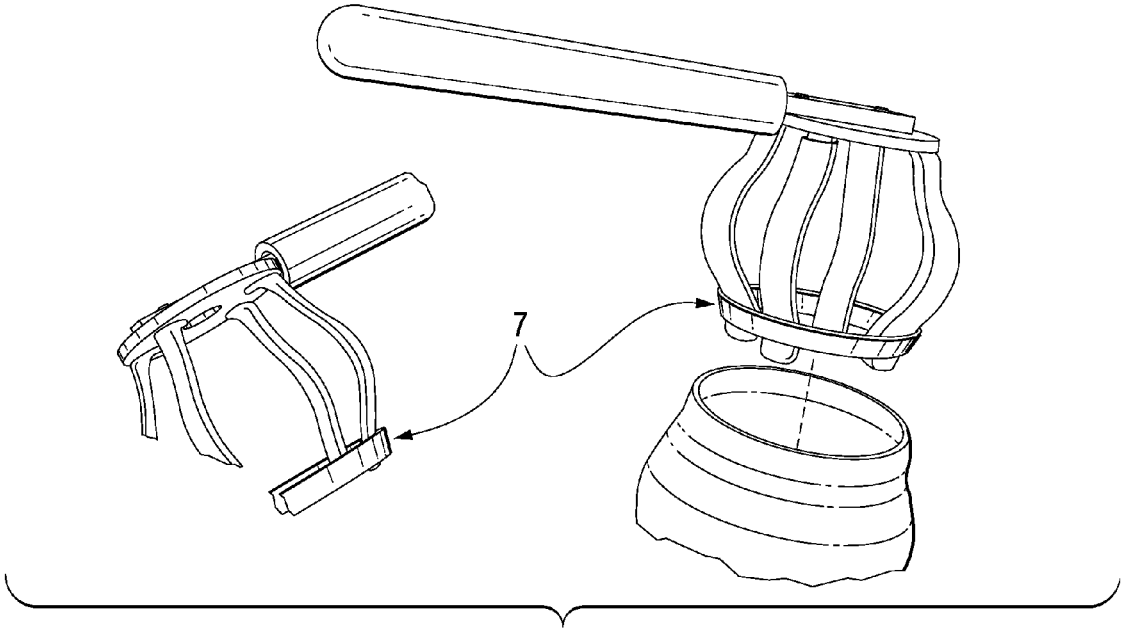

Another embodiment of the invention is depicted by reference to FIG. 5B. To provide additional gripping pressure between the extension(s) 2 and doorknob, a band 7 may be placed on the extension(s). The band 7 may comprise of rubber band(s), elastomeric material, neoprene, polymer or some other material which can be installed on the extension 2 to provide a gripping force.

Another embodiment of the invention is depicted by reference to FIG. 5A. To provide additional gripping pressure between the extension(s) 2 and doorknob, a cover 8 may be placed on the extension(s). The cover 8 may comprise of rubber, elastomeric material, neoprene, polymer or some other material which can be installed on the extension 2 to provide a gripping force, but will allow the cover 8 and invention 1 to slip over the doorknob.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

The invention claimed is:

1. A device for effectuating the movement of a doorknob, comprising:

a lever for exerting circular torque force on the doorknob;

one or more extensions having interior and exterior surfaces, unitary with a lever connection portion of said lever and extending outwardly therefrom, said extensions fitting over the doorknob, said extensions further exerting an inward force on the door knob and allowing the doorknob to turn; and a resilient band member, said resilient band member circumferentially surrounding said exterior surface of said one or more extensions such that said one or more extensions exert an additional inward force on said door knob;

wherein said resilient band member comprises an elastomeric material.

2. The device of claim 1, wherein said inner surface of said one or more extensions further comprises a gripping material.

3. The device of claim 2, wherein said gripping material is selected from the group consisting of rubber, neoprene and a polymer.

4. The device of claim 2, further comprising a cover encasing said extensions and said resilient band member.

5. The device of claim 4, wherein said cover is constructed from a material selected from the group consisting of rubber, neoprene and a polymer.

6. The device of claim 1, wherein said resilient band member is constructed from a material selected from the group consisting of rubber, neoprene and a polymer.

7. The device of claim 1, further comprising a cover encasing said extensions and said resilient band member.

8. The device of claim 7, wherein said cover is constructed from a material selected from the group consisting of rubber, neoprene and a polymer.

9. The device of claim 1 wherein said one or more extensions have varying lengths.

10. The device of claim 1 wherein said one or more extensions are curved to receive and restrain said doorknob.

* * * * *